US010124925B2

(12) United States Patent
Nikolic

(10) Patent No.: US 10,124,925 B2
(45) Date of Patent: Nov. 13, 2018

(54) SELF FOLDING BOX WITH A CARRIER FOR PACKING PIZZAS AND A TOOL FOR FORMING THE BOX

(71) Applicant: Ivan Nikolic, Beograd (RS)

(72) Inventor: Ivan Nikolic, Beograd (RS)

( * ) Notice: Subject to any disclaimer, the term of this patent is extended or adjusted under 35 U.S.C. 154(b) by 0 days.

(21) Appl. No.: 15/550,610

(22) PCT Filed: May 25, 2015

(86) PCT No.: PCT/RS2015/000012

§ 371 (c)(1),
(2) Date: Aug. 11, 2017

(87) PCT Pub. No.: WO2016/133419

PCT Pub. Date: Aug. 25, 2016

(65) Prior Publication Data

US 2018/0065772 A1 Mar. 8, 2018

(30) Foreign Application Priority Data

Feb. 18, 2015 (RS) ..... P-2015/0102

(51) Int. Cl.
*B65D 5/20* (2006.01)
*B65D 5/30* (2006.01)
(Continued)

(52) U.S. Cl.
CPC ..... *B65D 5/2028* (2013.01); *B65D 5/2033* (2013.01); *B65D 5/302* (2013.01);
(Continued)

(58) Field of Classification Search
CPC B65D 5/2028; B65D 21/0212; B65D 5/4295; B65D 3/302; B65D 2585/366;
(Continued)

(56) References Cited

U.S. PATENT DOCUMENTS

| | | | |
|---|---|---|---|
| 8,365,981 | B1 | 2/2013 | Perlsweig |
| 2005/0274780 | A1 | 12/2005 | Charlton |
| 2012/0037691 | A1 | 2/2012 | Hubbard, Jr. et al. |

FOREIGN PATENT DOCUMENTS

| | | | |
|---|---|---|---|
| DE | 29609114 | U1 | 9/1996 |
| DE | 20016110 | U1 | 1/2001 |
| WO | 2011060410 | A2 | 5/2011 |

*Primary Examiner* — Christopher Demeree
(74) *Attorney, Agent, or Firm* — The Watson IP Group, PLC; Jovan N. Jovanovic; Vladan M. Vasiljevic

(57) ABSTRACT

A self folding box with a carrier for packing of pizza, as well as a tool for forming the box, comprises a box (A) with a lower part (1) of the box and a cover (2) of the box, wherein on a bottom (1.1) of the lower part (1) of the box is placed a carrier (4) for two slices of pizza quarter. Lateral sides (1.2, 2.2), auxiliary sides (1.8, 2.8) and an opposite side (1.5, 2.5) are made around bottom (1.1, 2.1) both of the lower part (1) and the cover (2) of the box (A). The lateral sides (1.1, 2.1) and the auxiliary sides (1.8, 2.8) are mutually connected and locked by means of tongues (1.3) entering slots (1.10). The opposite side (1.5, 2.5) is locked in a slot (1.7) in the bottom (1.1, 2.1) by means of a tongue (1.6). The carrier (4) comprises two pads (3) for one slice of pizza quarter, which are superposed one on another, so that the tongues (3.3, 3.4, 3.6) of the sides (3.2) of the upped pad (3) enclose from outside the sides (3.2) of the lower pad (3), while the trapezoidal tongues (3.5) of the lower pad (3) enter the openings (3.7) of the upper pad (3). An auxiliary tongue (3.9) of the lower auxiliary carrier (3.8) encloses from outside the upper auxiliary carrier (3.8). The pad (3) for two slices of pizza quarter is formed by manual folding the cardboard formed unfolded blank (F) along the folding lines (3.21, 3.81, 3.91). Forming the box (A), i.e. both the lower part (1) and the cover (2) thereof is carried out in the same tool (9) that comprises a tool holder (9.1), on which is attached a tool bottom (9.2) with the sides (9.3, 9.4, 9.5, 9.6)
(Continued)

for forming the box. There is also a variant of the invention defined by the box (A1).

12 Claims, 10 Drawing Sheets

(51) Int. Cl.
*B65D 5/42* (2006.01)
*B65D 21/02* (2006.01)
*B65D 5/50* (2006.01)

(52) U.S. Cl.
CPC ..... *B65D 5/4295* (2013.01); *B65D 5/5035* (2013.01); *B65D 21/0212* (2013.01); *B65D 5/50* (2013.01); *B65D 2585/366* (2013.01)

(58) Field of Classification Search
CPC .. B65D 85/36; B65D 81/3406; B65D 5/2042; B65D 5/2061
USPC ..... 229/115, 902, 903, 906, 112, 195, 150, 229/145, 148, 149, 223, 107, 125.19, 229/125.29, 938, 125.28; 206/551
See application file for complete search history.

SELF FOLDING BOX WITH A CARRIER FOR PACKING PIZZAS AND A TOOL FOR FORMING THE BOX

FIELD OF TECHNOLOGY

The invention belongs to a field of packages intended for transportation of various materials, such as cardboard boxes.

In accordance with the International patent classification the invention is designated with the basic classification symbol: B65D 21/04 (2006.01) that comprises open-ended containers shaped to be nested when empty and to be superposed when full.

Technical Problem

How to realize a transport package for slices of pizza obtained by cutting pizza that has circular shape in quarters, sixths or eighths of a circle, wherein the obtained slices would not adhere to the package or to another slice; a package that keeps its form during packing of hot slices of pizza; a package whose outer side can be printed, while its inner side still complies with demands relating to food packing from standpoint of health safety and microbiology; a package that can be transported in sheets and be easily formed on the packing site, thus influencing on the low price of transport; a package which, if necessary, can be disinfected by means whose application is approved for use with food; a package that can be put in the bags having the most often used dimensions; a package whose price is competitive in comparison with existing cardboard and PET packages, wherein its internal side completely complies with aesthetic appearance that does not reveal a structure of cardboard used for forming the package, and also complies with protective, storage, transport, usability and ecological functions and it is in accordance with the standards and regulations relating to the appropriate field of technology.

STATE OF THE ART

It is generally accepted that packing material is the most important element in creation of appearance of packages and it practically determines a choice of manufacturing technology therefore. These facts have influenced the development both of polymeric materials and cardboard packages which in combination therewith enables safer packing in light cardboard boxes made from special cardboards coated with polymeric films resistant to heat, humidity etc.

In contemporary practice of entities that manufacture pizzas with high output packing process is divided into packing of slices of pizzas and packing of whole pizzas. A slice of pizza is obtained by cutting pizza in such way that an angle of 360° having its centre in the middle of the circular pizza is divided in quarters or sixths or eighths, i.e. one slice covers a space defined by an angle between a radius of the circle obtained by division of the angle of 360° having center in the center of the pizza and an arc over the angle that is defining the end of pizza. It means that slice of pica has approximately shape of an isosceles triangle, whose sides are radiuses of the circle, and instead a straight line, the third side is an arc of a circle over that angle. The most often angles obtained by the mentioned division are 90°, 60° and 40°. The most often used diameters of circles defining edges of pizza are 28 cm, 32 cm, 37 cm, 40 cm, 42 cm, 50 cm and 55 cm.

Problem related to packing slices of pizza is based on fact that to low price of slice of pizza is added price of a package complying with health safety and microbiological safety, thus causing its dramatic increase. In terms of economy a box for one slice of pizza is rarely used, while well known boxes on the market have been developed in terms of increasing surface area of the box in order to enable putting more slices inside it. Such solution is not always practical, because such large surface areas are difficult to pack into a bag, whilst the box must have protective PET layer due to the microbiological safety in its inner space, which causes further price increase. On the other hand, cardboards up to 450 g/m2, which can be printed by offset printing machines, often do not posses strength necessary for keeping their shape during packing, while corrugated cardboard is printed by different technologies that provide far worse quality of printing.

That was a reason why pizza manufacturers have started increasing size of slice of pizza up to ¼ of pizza, i.e. to divide an overall angle of 360° in parts each having 90°. A box for one slice of pizza, whose radiuses form an angle of 90°, has preferably square base, because usability of an unfolded blank of the box is the most efficient, while forming the box is very easy.

Hence for packing several slices are needed several boxes or, on the contrary, slices are superposed one on another. In order to avoid packing several slices in the same box, manufacturers often pack slices in cardboard boxes without PET layer, which do not comply with microbiological safety. Price of polymer packages is much higher, while space required for polymer packages is also larger, thus influencing both transport and storage costs, especially if the packages are filled in smaller objects located throughout the territory covered by the food manufacturer. Polymeric packages, which are exposed to high temperatures due to packing of hot food, are prone to deformation at raised temperature causing either degradation of aesthetical appearance of the package or raising its price, because the mentioned effect caused by heat can be minimized by use of thicker material.

The search carried out in the available patent documentation has not given any document with the same solution to the defined technical problem.

SUMMARY OF THE INVENTION

Novelty of the invention relies on that the box for packing slices of pizza consists of a carrier, which is formed by pads that are superposed one on another, and a box into which the carrier is inserted. The box for the carrier consists of two parts: a cover and a bottom. Both parts are quickly formed by use of the same tool in the first phase. The tool consists of a tool holder, which made of inox tin, and a forming part. The bottom of the tin part of the forming part has slightly bigger width and length than the bottom of the box, while its sides are slightly reduced by different slopes and lengths of the sides in order to determine sequence of folding the sides of the unfolded blank either of the cover or the bottom during forming the box. At that time, in the first phase a printed cardboard sheet is cut out by a die on a machine and is pressed both along the cutting and the folding lines, and after that the sheet is positioned above the tool for forming, then get pushed down, wherein the sheet entering the forming part of the tool obtains a shape either of the bottom or the cover, because its sides fold and position themselves in locking positions. The tools for forming the box from the state of the art are not used anymore, because of unpractical big surface area both of the bottom of the box and of the appropriate tool. In this phase the box obtains triangular shape with locking elements in position from which the locks are easily formed. The locks are made either as tongues entering the sides or the sides folding one over another, entering slots while preventing unfolding of the box.

The cover of the box as a separate element is similar to the unfolded blank of the bottom enabling use of the same tool for its forming.

Essence of the invention also resides in a fact that manual forming of the box is faster and insertion of the carrier into the box is easier.

The carrier is formed from the pads for pizza by superposing one on another and locking such obtained shape by the locking means on the pads. The pads consists of cardboard having thickness of 0.3-1.5 mm. A variety of materials fulfill these requirements, but we prefer cardboard, because thereon can be applied a material that enables a direct contact with food, e.g. cardboard with adhering aluminized PET film either on both sides or only on its inner side, and complies with all microbiological conditions in terms of health safety, especially for direct contact with food. The PET layer can be also made without the aluminized layer in order to enable use of the pad in microwave ovens. Essence of the invention is also in that by inserting the carrier with slices of pizza in oven, pizza may be heated to temperature up to 140° C. up to 15 minutes. The PET layer can be applied on cardboard either by means of extrusion or by hot or cold lumination.

Essence of the invention is also that in this way is enabled packing of slices of pizza one above another, wherein the carrier maintains its strength during packing of hot slices of pizza. The strength of the carrier also provides for strength of the box into it is inserted, thus enabling use of cardboard that can be printed for forming the box on the offset printing machines. Essence of the invention is also that a surface area of the bottom of the box is decreased, thus enabling packing of boxes in bags having smaller surface area, which are cheaper and more practical to users during transport. Essence of the invention is also that in case of packing of two or three slices, the price of the box increases only for the price of the pad, thus differentiating from the state of the art.

Dimensions of the most often cut slices of pizza differ one from another depending on a manner of division of a pizza in quarters, sixths or eighths, but different radiuses of circular pizza also demand different dimensions of the pad for one slice of pizza.

Difference in the dimensions of slices of pizza causes difference in construction of pads.

On the edge of their arcuate part the pads for packing slices of pizza quarter have an supplement, an auxiliary carrier which prevents bending of the pad and strengthens the carrier formed by their superposing one on another. Such pads form the carrier for a half of pizza and the shape of the box in which they are packed differs from the shape of the box for the carriers obtained by superposing the pads for slices of pizza sixth or eight one on another.

By superposition of three pads for slice of pizza sixth is enabled that a half of pizza can be placed in one carrier. From standpoint of the price of package and simultaneously considering a surface area occupied with the box for packing of pizza, the most economical are the packages for placing a half of pizza. We stress that superposition of pads one on another causes change in overall dimensions of the boxes into which they are placed. A form of the box for slices of pizza quarter generally differs from the one for other sizes of slices of pizza, because such box has the triangular bottom.

By superposition of the four pads for slices of pizza quarter is enabled that a whole pizza can be placed in the same carrier, while the box for such carrier keeps the same shape of the bottom and the cover, but its height changes, thereby causing a change of the unfolded blank of the box.

The self folding box with the tool for forming is transported and stored in sheets of cardboard, it can be also be branded, it is formed very easy manually with aid of the tool, it does not change its shape both in case of packing hot pizza or heating slices of pizza placed on the pads, it does not open during its transport except in case of very strong deformation caused by strike and it enables elegant use to an end user.

BRIEF DESCRIPTION OF DRAWINGS

The invention will be described in detail to a preferred embodiment of the invention and it is illustrated in drawings, wherein.

DETAILED DESCRIPTION OF THE INVENTION

Figure 1:
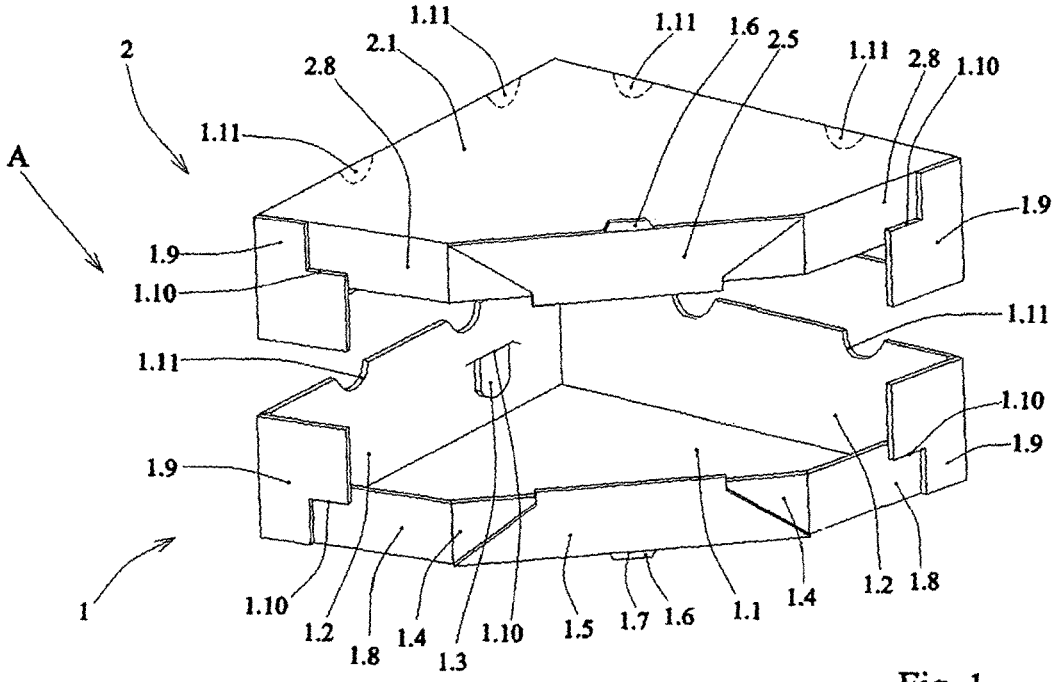
FIG. 1 shows a perspective view of a self folding box for packing one slice of pizza quarter in opened state of the box.
Figure 4:
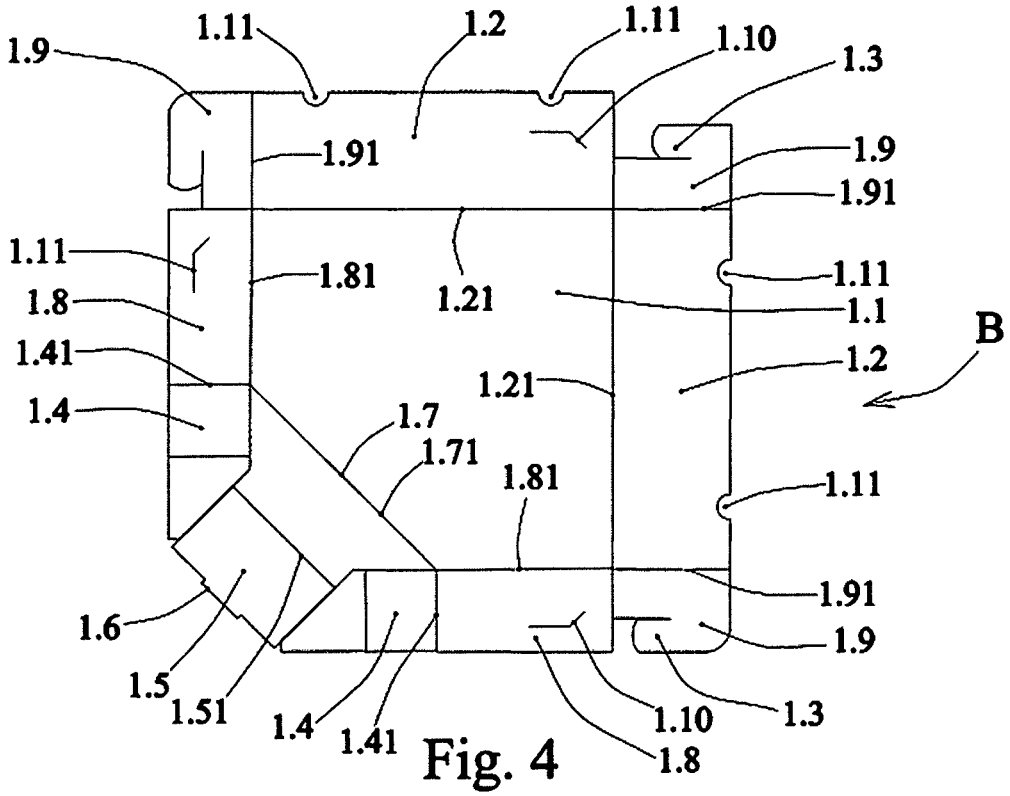
FIG. 4 shows an unfolded lower part of the box for packing one slice of pizza quarter from FIG. 1.
Figure 5:
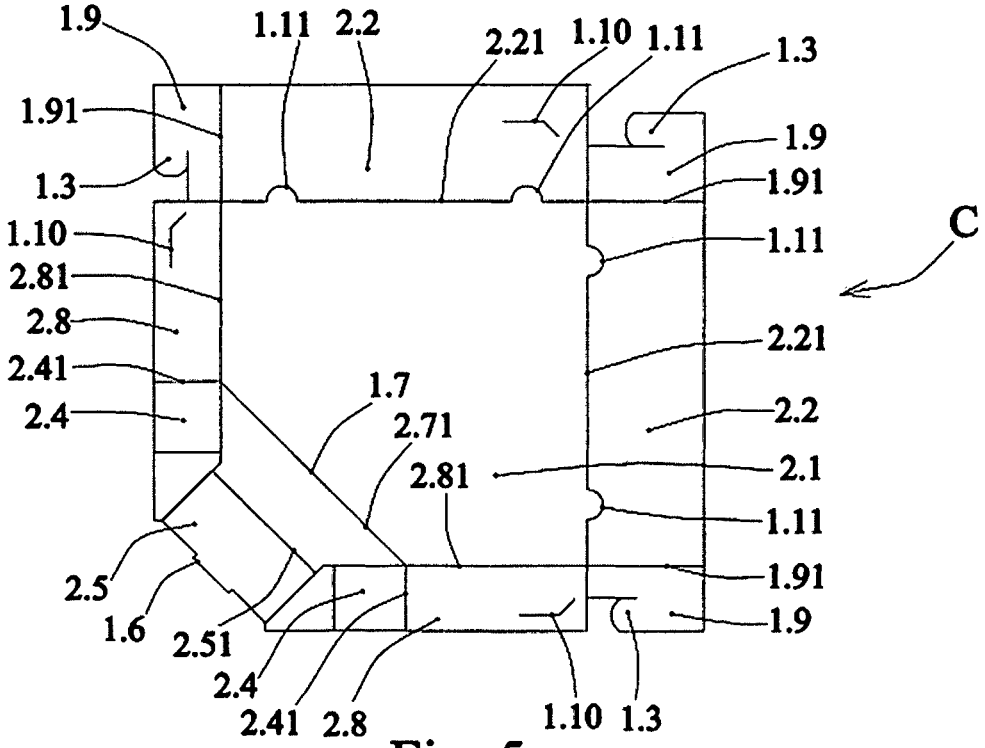
FIG. 5 shows an unfolded cover of the box for packing one slice of pizza quarter from FIG. 1.

A self folding box (A) for packing one slice of pizza quarter consists of a lower part (1) and a cover (2) (FIG. 1). The lower part (1) and the cover (2) are formed in a tool (FIG. 13) from previously prepared and formed unfolded blank (B) (FIG. 4) and unfolded blank (C) (FIG. 5) made of cardboard. Prepared cardboard is placed in a die (not shown). In the die are positioned knives both for cutting out contours of the sides and stamping out and making slots 1.7, 1.10 and semicircular vent openings 1.11, and inner knives that enter cardboard only partially making previously planned folding lines 1.21, 1.41, 1.51, 1.71 and 1.81 in cardboard of the unfolded blank B, which is intended for the lower part 1 of the box A. The unfolded blank C for the cover 2 of the box is differing from the unfolded blank B only by dimensions of the bottom 2.1 and the lateral sides 2.2 that are bigger in order to enable superposition of the cover 2 on the lower part 1 of the box. Another difference is that the semicircular openings 1.11 are cut out in the inner sides of the lateral sides 2.2, so when the cover 2 is placed on the lower part 1 of the box, then the semicircular openings 1.11 coincide one with another, thereby providing an opening for ventilation of pizza in order to prevent action of vapour.

Figure 13:
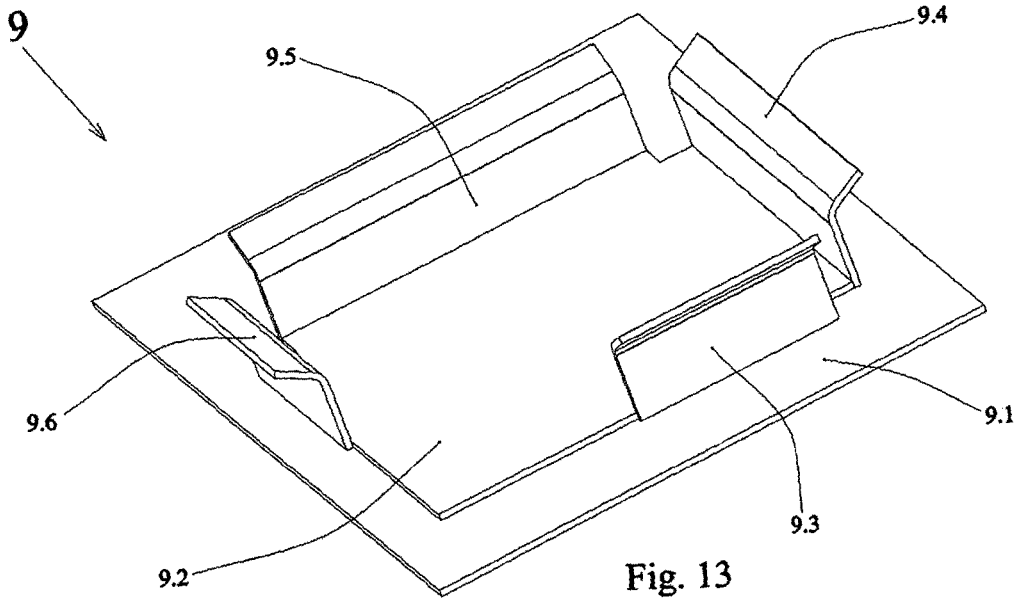
FIG. 13 shows a perspective view of a tool for forming the box from FIG. 1.

The lower part 1 of the box and the cover 2 of the box are formed in the tool 9 (FIG. 13). The formed unfolded blank B, C is placed above the tool 9 on the sides 9.3, 9.4, 9.5, 9.6 and a part of the formed unfolded blank B, C is being pressed on its bottom 1.1, 2.1 by hand until the bottom 1.1, 2.1 becomes pressed against the bottom 9.2 of the tool 9 among the sides 9.3, 9.4, 9.5, 9.6 of the tool 9. Thereby the sides 1.2, 2.2, 1.8, 2.8 of the formed unfolded blank B, C lean on the sides 9.3, 9.4, 9.5, 9.6 of the tool 9 and they become vertical in relation to the bottom 1.1, 2.1. In this position the folds 1.9 fold around the folding lines 1.91, so that the tongues 1.3 enter the slots 1.10 of the lateral sides 1.1, 2.2 and lock the auxiliary sides 1.8, 2.8 and the sides 1.2, 2.2, 1.8, 2.8 in a vertical position. Then the extensions 1.4, 2.4 fold inwards around the folding line 1.41, 2.41 and the opposite side 1.5, 2.5, which folds around the folding lines 1.51, 2.51, 1.71, encloses the extension 1.4, 2.4 in such way to become locked in the slot 1.7 in the bottom 1.1, 2.1 by means of the tongue 1.6.

Figure 2:
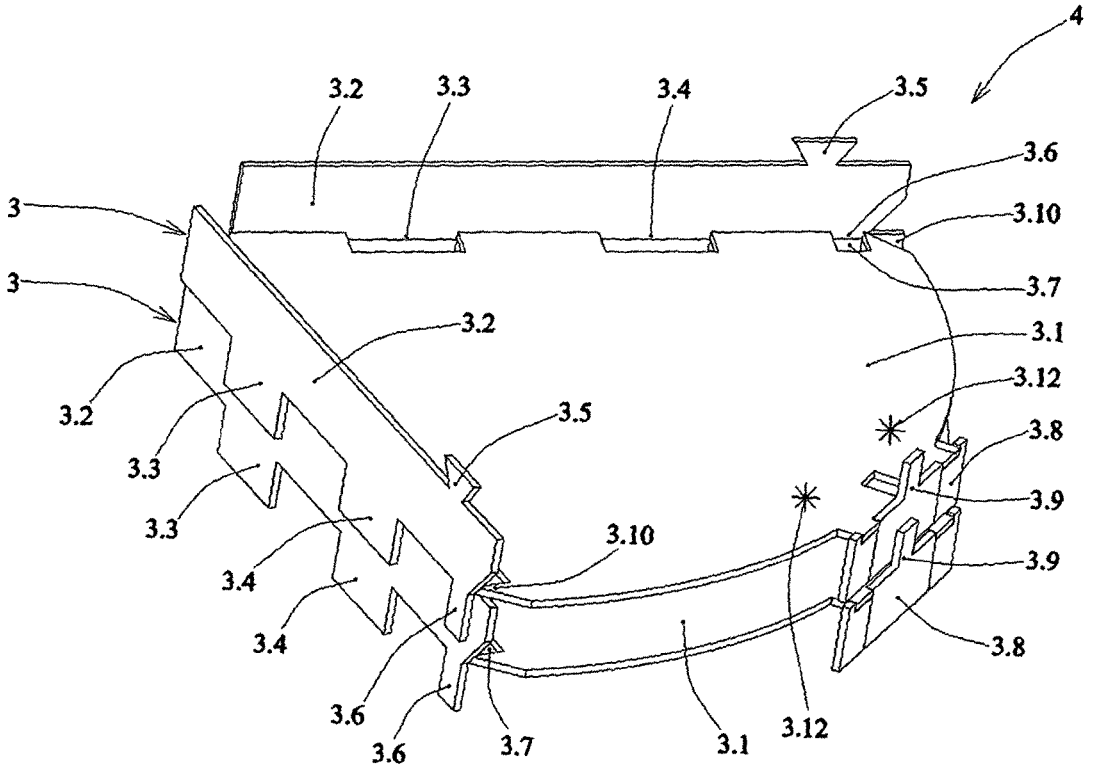
FIG. 2 shows a perspective view of a carrier for packing two slices of pizza quarter.

In the bottom 1.1 of the lower part 1 of the box A is placed a carrier 4 for two slices of pizza quarter (FIG. 2). The carrier 4 consists of two pads 3, which are superposed one on another so that the tongues 3.3, 3.4 and a next-to-arc tongue 3.6 of the sides 3.2 of the upper pad 3 enclose from outside the sides 3.2 of the lower pad 3, while the trapezoidal tongues 3.5 of the lower pad 3 enter the openings 3.7 of the upper pad 3 for pizza and mutually secure the connection of the both pads 3, whilst an auxiliary tongue 3.9 of the lower auxiliary carrier 3.8 encloses from the outside the upper auxiliary carrier 3.8.

Figure 3:
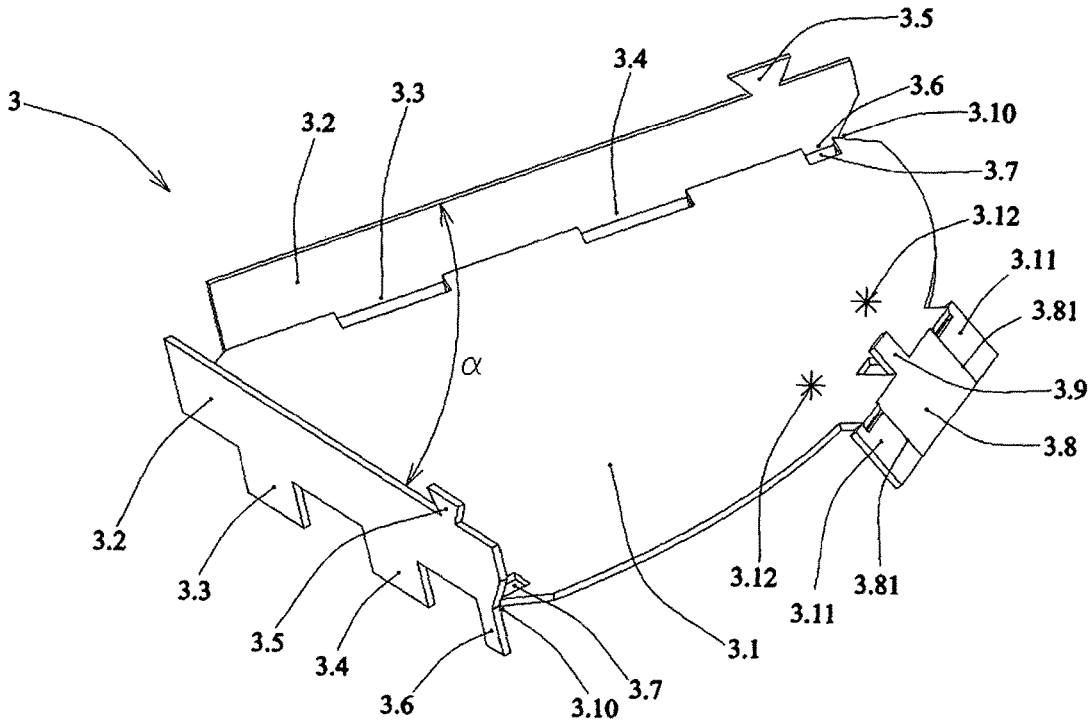
FIG. 3 shows a perspective view of a pad for pizza quarter.
Figure 6:
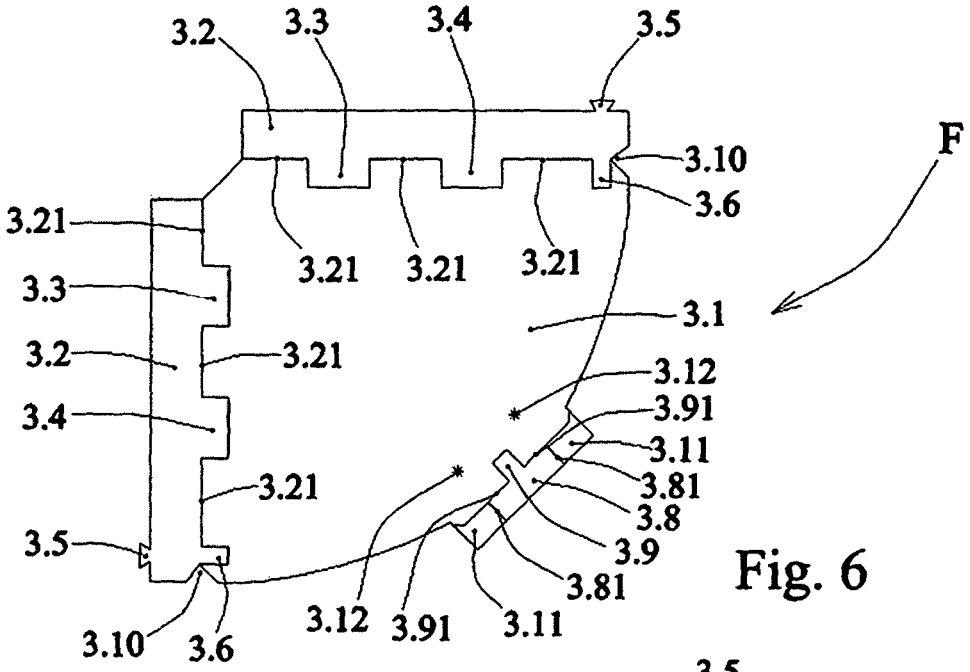
FIG. 6 shows a view of the unfolded pad for one slice of pizza quarter from FIG. 3.

The pad 3 (FIG. 3) for one slice of pizza quarter is formed by manual folding the formed unfolded blank F along the folding lines 3.21, 3.81, 3.91 (FIG. 6). The unfolded blank F is made of previously prepared cardboard with one applied layer or without it, which is placed in the die with the knives (not shown). The knives cut out the outer contour of the unfolded blank F together with a groove 3.10, an auxiliary carrier 3.8 on the next-to-arc part of the bottom 3.1 and a pivotable extension 3.11. The other knives cut out both the contoures of the tongues 3.3, 3.4, 3.6, 3.9 and the inner sides of the extensions 3.11, wherein star-shaped slots 3.12 have been cut out. The knives, which partially enter cardboard, form previously planned folding lines 3.21, 3.81, 3.91.

By folding the both sides 3.2 along the folding lines 3.21 upwards in a vertical position in relation to the bottom of the pad 3.1 the pads 3.3, 3.4 and the next-to-arc tongue 3.6 are moved downwards leaving the openings in the bottom 3.1 intended both for facilitating air flow and decreasing action of vapour on pizza. The auxiliary carrier 3.8 is folded downwards in a vertical position, while the pivotable extensions 3.11 of the auxiliary carrier fold inwards over the folding lines 3.81 in such way that sharp edges of the extensions 3.11 enter the star-shaped slots 3.12 in the bottom 3.1 of the carrier 3 for one slice of pizza quarter thereby securing vertical position of the auxiliary carrier 3.8 and the auxiliary tongue 3.9 that is placed onto it. The auxiliary tongue 3.9 prevents a slice of pizza quarter from falling from arcuate part of the pad 3. In another carrier 4, which is formed by superposition of two pads 3 one on another as previously described, can be placed one slice of pizza half, i.e. two slices of pizza quarter.

The pad 3 for one slice of pizza quarter has the bottom 3.1, which is formed with preferred angle $\alpha$=90°.

Figure 7:
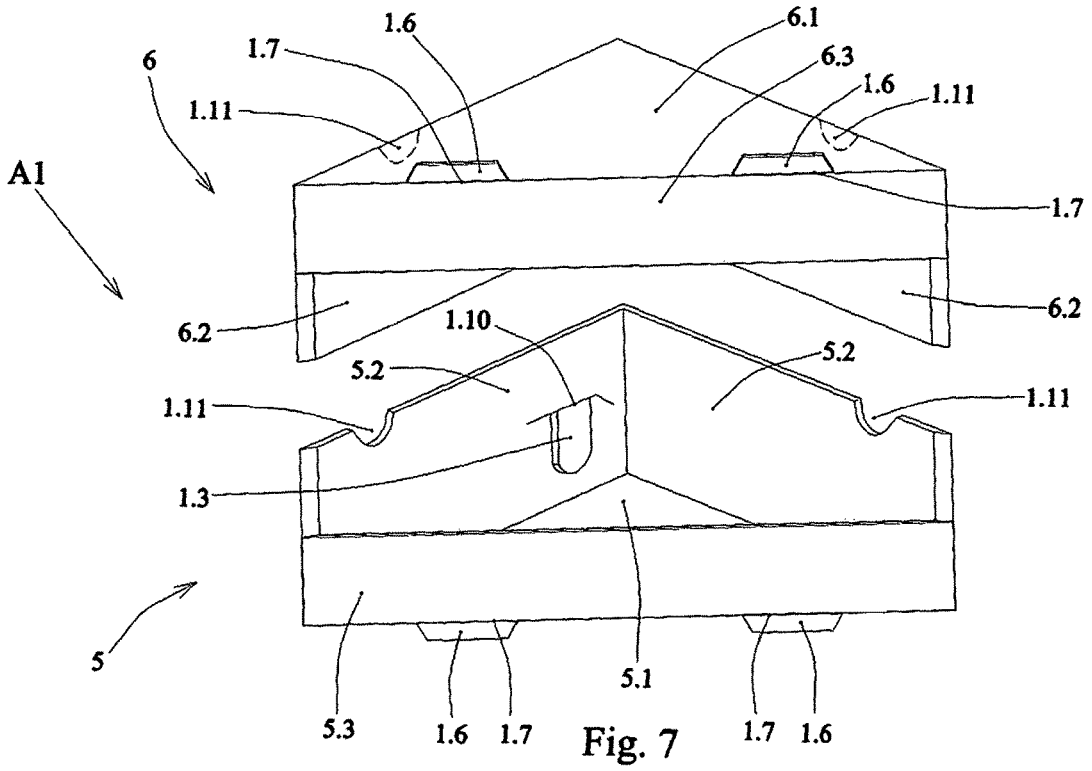
FIG. 7 shows a perspective view of the self folding box in variant I for packing one slice of pizza sixth in the opened state of the box.

Variant I of the self folding box A1 for packing pizza relates to a packing for one slice of pizza sixth. The box consists of the lower part 5 and the cover 6 (FIG. 7). In the lower part 5 of the box on its bottom 5.1, which has triangular shape, is placed the carrier 8 for one slice of pizza sixth. The carrier 8 consists of three pads 7 that are superposed one on another, same as the carrier 3 for one slice of pizza quarter. The pad 7 for one slice of pizza sixth differs from the pad 3 for one slice of pizza quarter in that the bottom 7.1 is formed with preferred angle $\alpha$1=60° and does not have an auxiliary carrier 3.8.

The lower part 5 of the box A1 and the cover 6 are formed in a tool that is same as the tool shown in FIG. 13 differing from it only in that it has a triangular bottom (not shown). The formed unfolded blank D, E is placed above the tool and the bottom of the formed unfolded blank D, E is being pressed on its bottom 5.1, 6.1 by hand until the bottom 5.1, 6.1 becomes pressed against the bottom of the tool for forming among the sides of the tool. Thereby the sides 5.2, 6.2 of the formed unfolded blank D, E lean on the sides of the tool and become vertical in relation to the bottom 5.1, 6.1. In this position the fold 1.9 folds around the folding line 1.91, so that the tongue 1.3 enters the slot 1.10 of the lateral side 5.2, 6.2 and locks the sides 5.2, 6.2 in a vertical position in relation to the bottom 5.1, 6.1. Then the extensions 5.4, 6.4 of the sides 5.2, 6.2 fold inwards around the folding lines 5.41, while the opposite side 5.3, 6.3, which folds around the folding lines 5.31, 5.71, 6.31, 6.71, encloses the extensions 5.4, 6.4 in such way to become locked in the slots 1.7 in the bottom 5.1, 6.1. by means of the tongues 1.6.

Figure 8:
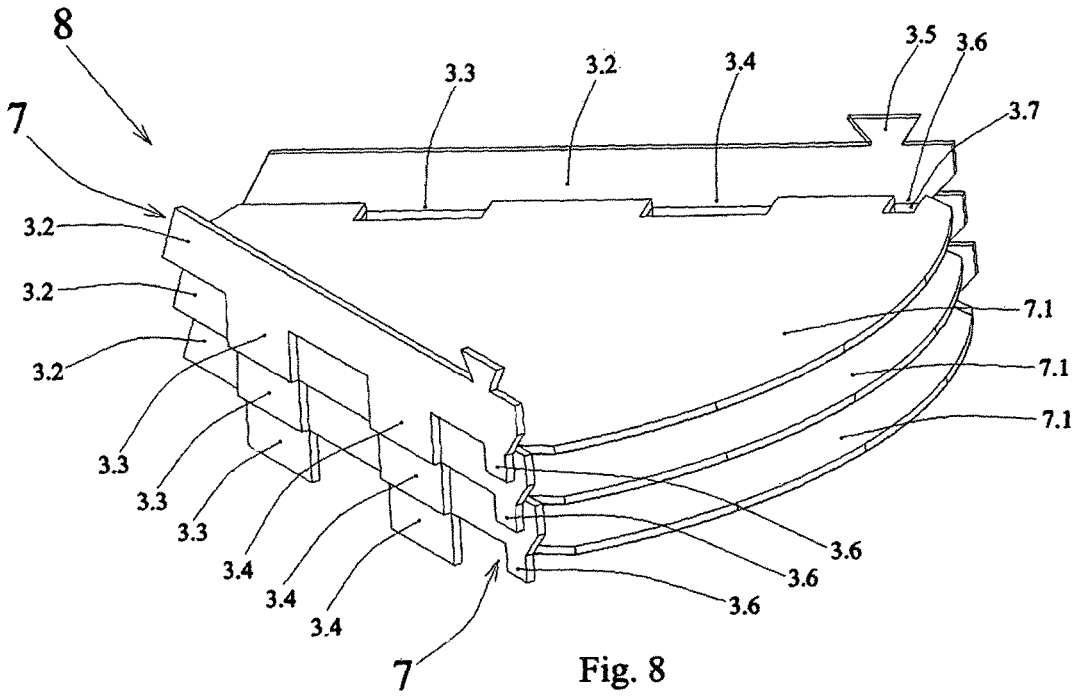
FIG. 8 shows a perspective view of carrier for packing three slices of pizza sixth.
Figure 9:
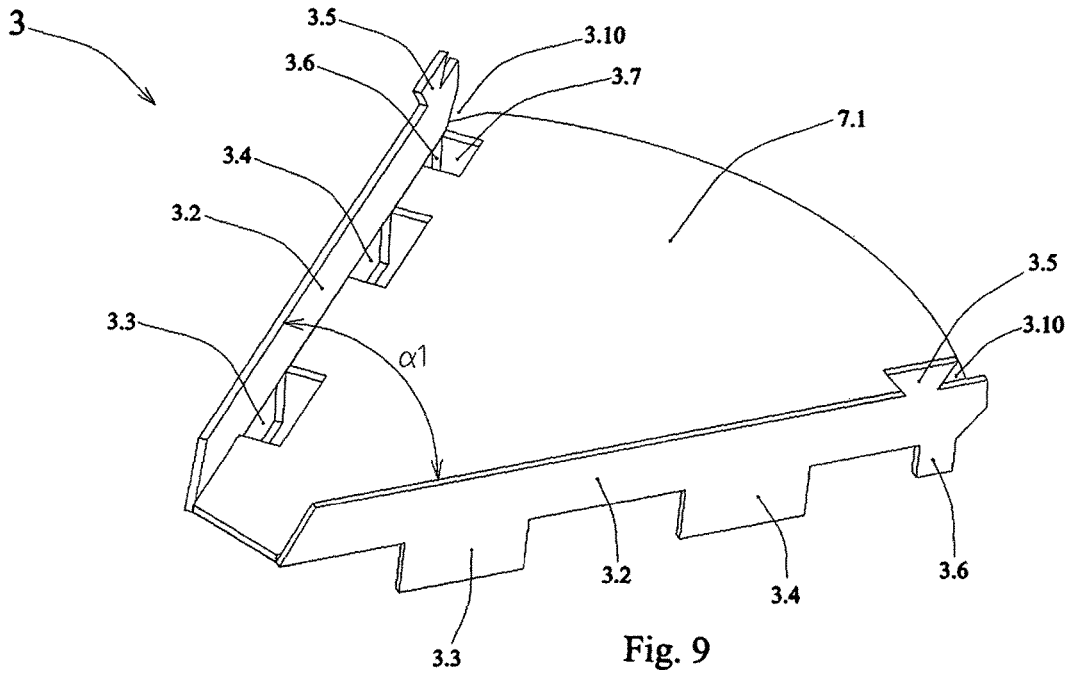
FIG. 9 shows a perspective view of the pad for one slice of pizza sixth.
Figure 10:
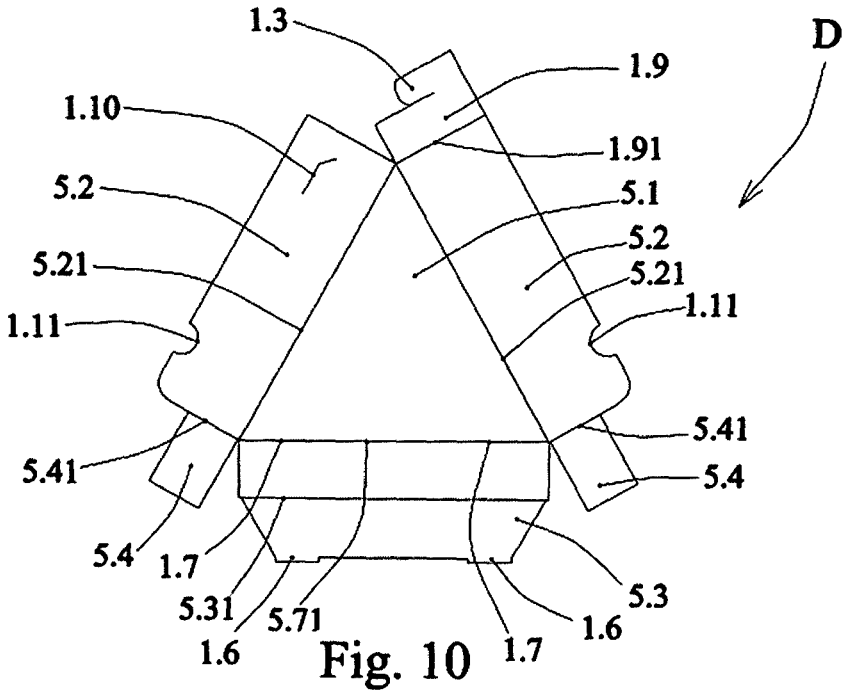
FIG. 10 shows an unfolded lower part of the box for packing one slice of pizza sixth from FIG. 7.
Figure 11:
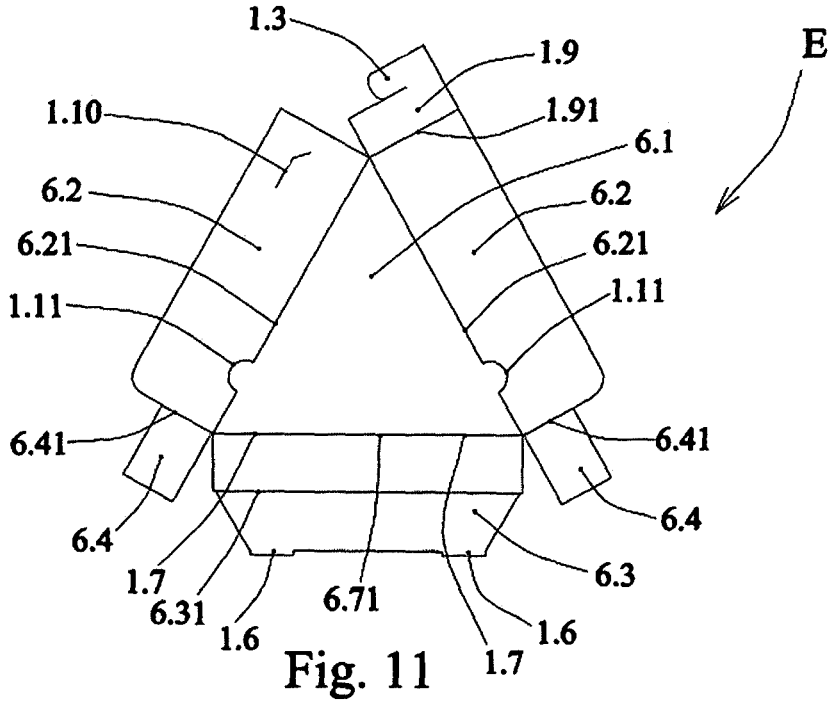
FIG. 11 shows the unfolded cover of the box for packing one slice of pizza sixth from FIG. 7.

In the lower part 5 of the box on the bottom 5.1 is placed the carrier 8 for three slices of pizza sixth (FIG. 8). The carrier 8 consists of three pads 7 that are superposed one on another so that the tongues 3.3, 3.4, 3.6 of the sides 3.2 of the upper pad 7 enclose from outside the sides 3.2 of the lower pad 7, whilst the trapezoidal tongues 3.5 of the lower pad 7 enter the openings 3.7 of the upper pad 7 for one slice of pizza sixth and mutually secure connection of all three pads 7.

Figure 12:
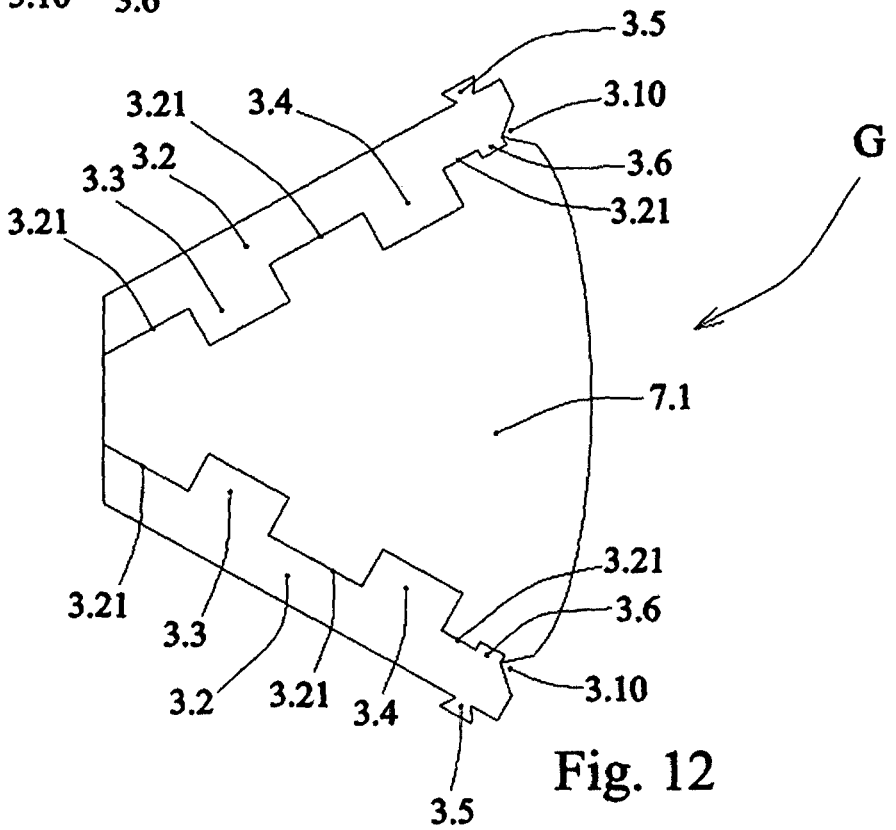
FIG. 12 shows a view of the unfolded pad for one slice of pizza sixth from FIG. 9.

The pad 7 (FIG. 8) is formed by manual folding the formed unfolded blank G along the folding lines 3.21 (FIG. 12). By means of folding of the both sides 3.2 along the folding lines 3.21 upwards in a vertical position in relation to the bottom 7.1 of the pad 7, the tongues 3.3, 3.4 and the next-to-arc tongue 3.6 move downwards leaving the openings in the bottom 7.1 intended both for facilitating air flow and decreasing action of vapour on pizza. The pad 7 can also serve for smaller slices of pizza such as e.g. pizza eight, wherein it is only changed an angle $\alpha$1 of the bottom 7.1 and the rest stay unchanged. The pad 7 for one slice of pizza quarter has got the bottom 7.1, which is formed with preferred angle $\alpha$1, most preferably $\alpha$1=60°.

Forming the box A is done in a tool 9 for forming (FIG. 13), that is same as previously described.

The tool consists of a tool holder 9.1, on which is attached a tool bottom 9.2. On the tool bottom 9.2 are made sides 9.3, 9.4, 9.5, 9.6, which are inclined in the upper part in order to enable easier sliding of the sides of the unfolded blank B, C, which is placed above it, next to them.

The invention claimed is:

1. A self folding box with a carrier for packing of pizzas, characterised in that a carrier (4, 8) structurally configured for two slices of a pizza quarter is placed on a bottom (1.1, 5.1) of a lower part (1, 5) of a box (A, A1) with a cover (2, 6), wherein the carrier (4) comprises at least two pads (3), each for one slice of pizza quarter, which are superposed one on another, so that a plurality of tongues (3.3, 3.4) and a next-to-arc tongue (3.6) of a plurality of sides (3.2) of an upper pad (3) of the at least two pads enclose the plurality of sides (3.2) of a lower pad (3) of the at least two pads from the outside, while a plurality of trapezoidal tongues (3.5) of the lower pad (3) are placed in openings (3.7) of the upper pad (3), whilst an auxiliary tongue (3.9) of a lower auxiliary carrier (3.8) encloses an upper auxiliary carrier (3.8) from the outside.

2. The box in accordance with claim 1, characterised in that each of the at least two pads (3) is formed by manual folding an formed unfolded blank (F) along a plurality of folding lines (3.21, 3.81, 3.91), wherein a bottom (3.1) of each of the pads (3) with preferred angle $\alpha$=90° encloses the plurality of sides (3.2) with the tongues (3.3, 3.4) and the next-to-arc tongue (3.6) on a lower side of the side (3.2) and the trapezoidal tongue (3.5) on an upper side of the plurality of sides (3.2), while the auxiliary carrier (3.8) with the auxiliary tongue (3.9) is made in an arcuate part of the bottom (3.1).

3. The box in accordance with claim 1, characterised in that the lower part (1) and the cover (2) of the box (A), which have been formed by folding an unfolded blank (B, C) around a plurality of folding lines (1.21, 1.41, 1.71, 1.81, 2.21, 2.41, 2.71, 2.81), comprises the bottom (1.1, 2.1), a plurality of lateral sides (1.2, 2.2), a plurality of auxiliary sides (1.8, 2.8) with a plurality of extensions (1.4, 2.4) and a plurality of opposite sides (1.5, 2.5).

4. The box in accordance with claim 3, characterised in that the plurality of lateral sides (1.2, 2.2) are folded around respective ones of the folding lines (1.21, 2.21) and are mutually connected by a fold (1.9) that is twisted around folding lines (1.91), so that a tongue (1.3) of the fold (1.9) is locked in a slot (1.10) of one of the lateral sides (1.2, 2.2), wherein the lateral sides (1.2, 2.2) are perpendicular to the bottom (1.1, 2.1).

5. The box in accordance with claim 3, characterised in that the plurality of auxiliary sides (1.8, 2.8) are folded around the folding lines (1.81, 2.81) and are connected with the plurality of lateral sides (1.2, 2.2) by respective folds (1.9) that are folded around the respective folding lines (1.91), so that respective tongues (1.3) are locked in the slots (1.10) of the auxiliary sides (1.8, 2.8).

6. The box in accordance with claim 3, characterised in that the extensions (1.4, 2.4) of the auxiliary sides (1.8, 2.8) are folded inwards around the folding lines (1.41, 2.41) and they enclosed by the opposite side (1.5, 2.5) that is folded around a plurality of folding lines (1.51, 2.51, 1.71, 2.71) and locked by a tongue (1.6) in a slot (1.7) made in the bottom (1.1, 2.1).

7. The box in accordance with claim 3, characterised in that a plurality of semicircular vent openings (1.11) are made in the lateral sides (1.2, 2.2) of the lower part (1) and the cover (2).

8. A self folding box with a carrier for packing of pizzas, characterised in that the carrier (8) is structurally configured for one slice of pizza sixth, which is placed on a bottom (5.1) of a lower part (5) of a box (A1), comprises at least three pads (7), which are superposed one on another, so that a plurality of tongues (3.3, 3.4) and a next-to-arc tongue (3.6) of a plurality of sides (3.2) of an upper pad (3) of the at least three pads enclose the plurality sides (3.2) of a lower one of the at least three pads (7) from outside, while a plurality of trapezoidal tongues (3.5) of a lower one of the at least three pads (7) are placed in a plurality of openings (3.7) of the upper pad (7) of the at least three pads, and each of the at least three pads (7) is formed by manual folding a formed unfolded blank (G) along a plurality of folding lines (3.21), wherein a bottom (7.1) of each one of the at least three pads (7) with preferred angle $\alpha$1=60° encloses the plurality of sides (3.2) with the plurality of tongues (3.3, 3.4) and the next-to-arc tongue (3.6) on a lower side of one of the plurality of sides (3.2) as well as the trapezoidal tongue (3.5) on an upper side of one of the plurality of sides (3.2).

9. The box in accordance with claim 8, characterised in that the lower part (5) of the box and the cover (6) of the box (A1), which have been formed by folding an unfolded blank (D, E) along a plurality of folding lines (5.21, 5.31, 5.41, 5.71, 1.91, 6.21, 6.31, 6.41, 6.71), comprises a bottom (5.1, 6.1), a plurality of lateral sides (5.2, 6.2) and a plurality of opposite sides (5.3, 6.3).

10. The box in accordance with claim 9, characterised in that the lateral sides (5.2, 6.2) are folded around a plurality of folding lines (5.21, 6.21) and are mutually connected by a fold (1.9) that is folded around a folding line (1.91), so that a tongue (1.3) of the fold (1.9) is locked in a slot (1.10) made in one of the lateral sides (5.2, 6.2), wherein the lateral sides (5.2, 6.2) are perpendicular to the bottom (5.1, 6.1).

11. The box in accordance with claim 10, characterised in that the extensions (5.4, 6.4) of the lateral sides (5.2, 6.2) are folded inwards around the folding lines (5.41, 6.41) and they are enclosed by the opposite side (5.3, 6.3) which is folded around a plurality of folding lines (5.31, 6.31, 5.71, 6.71) and locked by a tongue (1.6) in a slot (1.7) made in the bottom (5.1, 6.1).

12. The box in accordance with claim 9, characterised in that semicircular vent openings (1.11) are made in the sides (5.2, 6.2) both of the lower part (5) and the cover (6).

* * * * *